United States Patent [19]

Murase

[11] Patent Number: 4,689,028

[45] Date of Patent: Aug. 25, 1987

[54] ENGINE FOR SMALL WATERCRAFT

[75] Inventor: Masaaki Murase, Kakogawa, Japan

[73] Assignee: Kawasaki Jukogyo Kabushiki Kaisha, Kobe, Japan

[21] Appl. No.: 828,337

[22] Filed: Feb. 11, 1986

[30] Foreign Application Priority Data

Feb. 13, 1985 [JP] Japan ..... 60-18603[U]

[51] Int. Cl.[4] ..... B63H 21/38

[52] U.S. Cl. ..... 440/88; 123/73 R; 123/198 R

[58] Field of Search ..... 440/38, 88, 89, 900; 123/73 R, 198 R

[56] References Cited

U.S. PATENT DOCUMENTS

| | | | |
|---|---|---|---|
| 2,209,301 | 7/1940 | Johnson et al. | 440/88 |
| 3,623,447 | 11/1971 | Jacobson | 440/88 |
| 4,288,176 | 9/1981 | Devine | 114/222 |
| 4,403,972 | 9/1983 | Bland et al. | 440/88 |
| 4,461,250 | 7/1984 | Mohr | 440/88 |
| 4,512,294 | 4/1985 | Mohr | 440/88 |

*Primary Examiner*—Joseph F. Peters, Jr.
*Assistant Examiner*—Stephen P. Avila
*Attorney, Agent, or Firm*—Leydig, Voit & Mayer

[57] ABSTRACT

A two-cycle engine for small watercraft for driving a propeller shaft includes a water discharge passageway located in the crankcase of the engine for communicating the crank chamber with outside to discharge water from the crank chamber. A closing member having a manually operated portion for opening and closing the closing member is fitted in the water discharge passageway. When it is desired to discharge water from the crank chamber, the manually operated portion is manipulated to open the closing member, so that the water can be discharged therefrom to outside via the water discharge passageway without requiring to remove the engine from the engine room.

8 Claims, 6 Drawing Figures

ENGINE FOR SMALL WATERCRAFT

BACKGROUND OF THE INVENTION

This invention relates to an engine for small watercraft capable of discharging water collected in a crank chamber of a two-cycle engine driving a propeller shaft.

One type of small watercraft adapted to be driven by a driver in a standing or sitting position for movement on the water may be constructed such that it can be readily righted when turned over.

However, when the small watercraft turns over, water might enter into the engine through a suction inlet port opening in the engine cover for the engine and find its way into the crank chamber of the engine through the air cleaner. When the engine is constructed such that cooling water is led to the exhaust muffler after cooling the engine, the injected water might flow backwardly when the watercraft turns over laterally and enter the crank chamber via the combustion chamber.

Once water enters the crank chamber, the engine would stop and difficulty would be experienced in restarting it.

Engines for a small watercraft of the prior art are constructed such that the water collected in the crank chamber possesses a problem which is hard to solve. Thus, when water entered the crank chambers, it has hitherto been usual practice to remove the engine from the engine housing and start it by turning it through 180 degrees after removing the ignition plug therefrom, so as to discharge the water from the crank chamber.

The process described hereinabove is troublesome and makes it impossible to restart the engine quickly because the engine should be removed from the engine housing and turned through 180 degrees. Moreover, when the engine is mounted in the engine housing again, it is necessary to effect centering of the crankshaft of the engine with respect to the propeller shaft. Thus, the process is very low in operability.

SUMMARY OF THE INVENTION

This invention has been developed for the purpose of obviating the aforesaid problem of the prior art. Accordingly, the invention has as its object the provision of an engine for small watercraft which can be restarted quickly, when water collects in the crank chamber, after the water is readily discharged from the crank chamber without removing the engine from the engine housing and by thereby eliminating the need to effect shaft centering which would be necessary if the engine were removed from the engine room or housing.

To accomplish the aforesaid object, the invention provides a water discharge passageway located in the crankcase of a two-cycle engine for driving a propeller shaft to communicate the crank chamber with outside, and a closing member having a manually operated portion for opening and closing the closing member.

DESCRIPTION OF THE PREFERRED EMBODIMENTS

Preferred embodiments of the invention will now be described by referring to the accompanying drawings.

Figure 1:
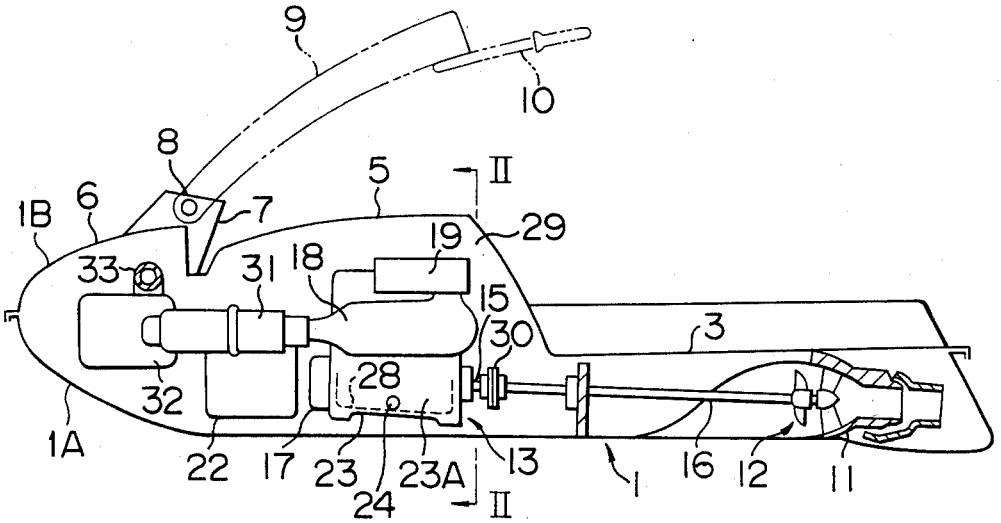
FIG. 1 is a sectional side view of a small watercraft mounting the engine comprising one embodiment of the invention.
Figure 2:
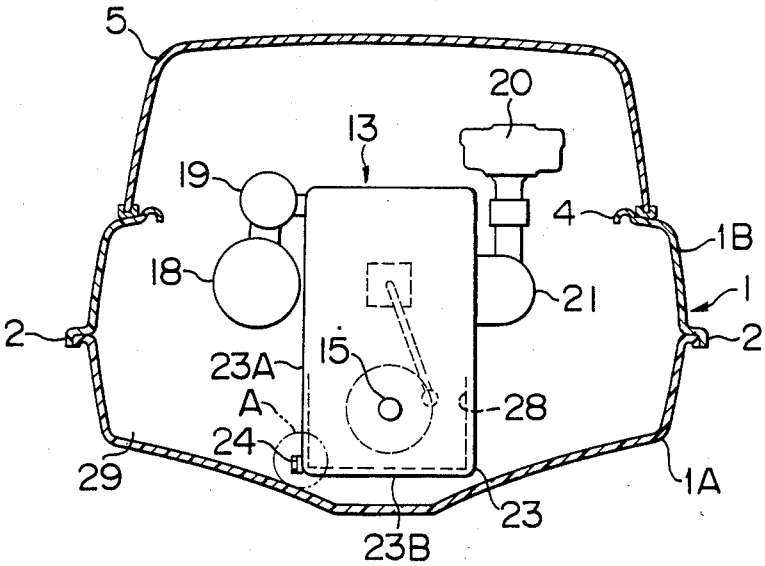
FIG. 2 is a sectional view taken along the line II—II in FIG. 1.
Figure 3:
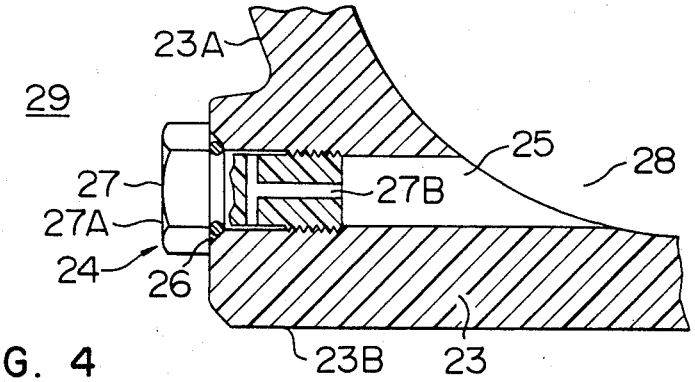
FIG. 3 is a sectional view, on an enlarged scale, of the section A shown in FIG. 2.

FIGS. 1 to 3 show one embodiment in which the reference numeral 1 designates a body of the watercraft comprising a hull 1A, and a deck 1B having a flange 2 at its periphery for fastening the deck 1B to the hull 1A. A floor 3 is located in a rearward portion of the body 1 while an opening 4 is formed in a forward portion thereof.

The numeral 5 designates an engine cover closing from above the opening 4 formed in the forward portion of the body 1.

As shown in FIG. 1, a pole bracket 7 is attached to a bow 6 of the body 1 and projects upwardly for supporting, through a pivot shaft 8, a handle pole 9 at its forward end for vertical pivotal movement. A handle lever 10 for steering the body 1 is attached to a rear end of the handle pole 9.

A duct section 11 and water jet propulsion means 12 are located in the rearward portion of the body 1.

The water jet propulsion means 12 is driven by a two-cycle engine 13 mounted in the forward portion of the body 1.

The reference numerals 15 and 16 designate a crankshaft and a propeller shaft, respectively. The engine 13 is coupled to the propeller shaft 16 by a coupling 30.

A flywheel cover 17 mounting therein a flywheel provided with an ignition magnet projects forwardly from a front surface of the engine 13 having the aforesaid power transmission system. An exhaust manifold 19 and a muffler 18 are located on the left side of the engine 13. To silence noises and cool the exhausts, water is supplied to the muffler 18 via the manifold 19 after the engine 13 is cooled. The reference numerals 31 and 32 designate an exhaust silencer and an exhaust chamber, respectively. An exhaust pipe 33 connected to the exhaust chamber 32 is connected to an opening, not shown, formed on the port side of the deck 1B.

A suction manifold 21 having an air cleaner 20 is located on the right side of the engine 13, as shown in FIG. 2. Air is supplied to the air cleaner 20 via an air inlet port, not shown, formed in the engine cover 5 and a suction duct, not shown.

The reference numeral 22 shown in FIG. 1 designates a fuel tank which is located forwardly of the engine 13.

The small watercraft of the aforesaid construction is equipped with a water discharge device 24 located in a lower portion of the port side of a of a crankcase 23 of the engine 13.

Referring to FIG. 3, the water discharge device 24 comprises a water discharge passageway 25 formed at a left side wall 23A of the crankcase 23, a water discharge port 26 located at one end of the water discharge passageway 25 at its outlet end, and a closing member 27 threadably fitted in the water discharge port 26.

The water discharge passageway 25 communicates a crank chamber 28 with an engine or housing 29 outside the crankcase 23 and is in the form of a threaded duct.

The closing member 27 is a drain plug formed with a passageway 27B and having at one end thereof a manually operated portion 27A of a hexagonal head type that can be manually operated from outside as by an ignition plug wrench.

The closing member 27 may be located on the starboard side of the engine 13. However, lack of space makes it impossible to mount the closing member 27 on the bow or stern side of the engine 13 because the crankshaft 15, flywheel cover 17 and coupling 30 are located on those sides.

When the small watercraft is capsized, the cooling water in the muffler 18 and exhaust manifold 19 would flow backwardly into the engine 13 and might collect in the crank chamber 28. Water might enter the engine housing 29 through the air inlet port of the engine cover 5 and find its way into the crank chamber 28. When this happens, the engine cover 5 is removed first of all, and then the body 1 is tilted through over 90 degrees to discharge the water from the engine housing 29 through the opening 4.

As described hereinabove, the water discharge device 24 communicating the crank chamber 28 with the outside, such as the engine housing, is formed, as shown in FIG. 3, in the crankcase 23 of the two-cycle engine 13 which drives the propeller shaft 16 shown in FIG. 1, and the water discharge passageway 25 has the closing member 27 having the manually operated portion 27A for opening and closing the closing member 27. By virtue of this arrangement, when water enters the crank chamber 28, it is possible to discharge the water from the crank chamber 28 through the water discharge passageway 25 by manually operating the manually operated portion 27A to open the closing member 27.

In operating the manually operated portion 27A, it is not necessary to remove the engine 13 from the propeller shaft 16, much less from the body 1 of the watercraft. One only has to open the engine cover 5 and extend the hand to the manually operated portion 27A (FIG. 3), to readily discharge the water through the water discharge passageway 25.

When the water is discharged as aforesaid, the crankshaft 15 remains connected to the propeller shaft 16. Thus, the need to effect centering of the crankshaft 15 with respect to the propeller shaft 16 which is necessary when the engine 13 is removed is eliminated.

Figure 4:
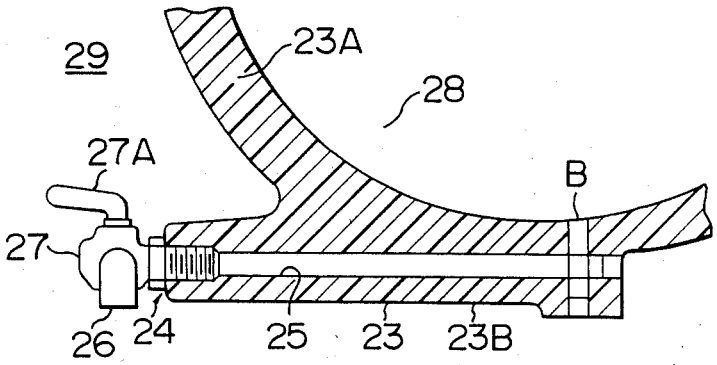
FIG. 4 is a view similar to FIG. 3 but showing the engine comprising another embodiment of the invention.

FIG. 4 shows another embodiment of the water discharge device 24. If the closing member 27 were located in a bottom wall 23B of the crankcase 23, the water in the crankcase 23 could be effectively discharged therefrom. However, difficulty would be encountered in having access to the closing member 27 if it were located in the bottom wall 23B of the crankcase 23. Therefore, in this embodiment, the water discharge passageway 25 is in the form of a letter L and extends from the center of the bottom wall 23B of the crankcase 23 which is in the lowest position to a left side wall 23A of the crankcase 23, and the closing member 27 of a lever cock type is fitted to an end of the water discharge passageway 25.

This facilitates the manipulation of the closing member 27 because it is located at one side of the crankcase 23. Particularly because an end of the water discharge passageway 25 opening in the crank chamber 28 is located in a lowest position B of the crank chamber 28, this embodiment has the effect of letting all the water in the crank chamber 28 be discharged therefrom.

Figure 5:
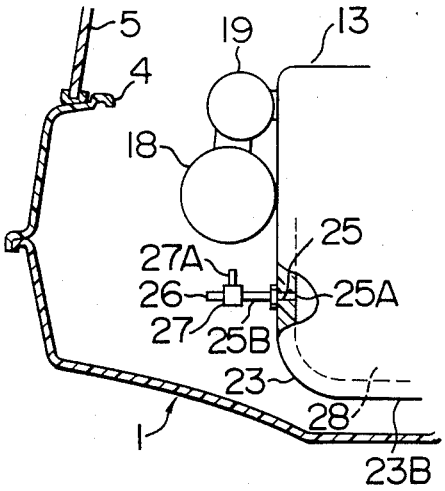
FIG. 5 is a fragmentary sectional view of the engine comprising still another embodiment of the invention.

FIG. 5 shows still another embodiment of the water discharge device 24 in which the water discharge passageway 25 is composed of an inner passageway portion 25A formed in the left side wall 23A of the crankcase 23, and a drain pipe 25B connected to the inner passageway portion 25A and projecting laterally. In this embodiment, the closing member 27 is located in a relatively high position with respect to the left side wall 23A of the crankcase 23, not in a low position near the lower end of the left side wall 23A of the crankcase 23.

Figure 6:
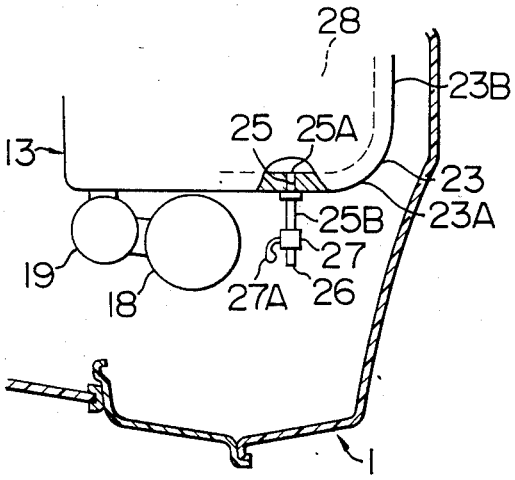
FIG. 6 is a fragmentary sectional view of the engine shown in FIG. 5, shown in a condition in which water is being discharged from the crank chambers.

The closing member 27 located in a relatively high position can be readily manipulated through the opening 4. Moreover, if the body 1 is turned laterally through 90 degrees as shown in FIG. 6, it is possible to discharge water without removing the engine 13 because the closing member 27 is disposed on the underside of the crankcase 23.

From the foregoing description, it will be appreciated that according to the present invention a water discharge passageway communicating the crank chamber with the atmosphere is formed in the crankcase of a two-cycle engine driving a propeller shaft for rotation, and a closing member having a manually operated portion for opening and closing the closing member is fitted in the water discharge passageway. By virtue of this feature, water collecting in the crank chamber can be readily discharged therefrom without removing the engine and the engine can be restarted quickly. Since the need to remove the engine is eliminated, it is not necessary to effect centering of the crankshaft with respect to the propeller shaft.

What is claimed is:

1. A two-cycle inboard engine for driving a propeller shaft of a small watercraft, comprising:

a water discharge passageway having the form of an L located in a crankcase of the engine and extending laterally through a bottom wall of the crankcase for communicating a crank chamber with the atmosphere; and a closing member fitted in said water discharge passageway, said closing member having a manually operated portion for opening and closing said closing member.

2. An engine for small watercraft as claimed in claim 1 wherein said closing member is located at one end of the water discharge passageway.

3. An engine for small watercraft as claimed in claim 1 wherein said water discharge passageway is oriented substantially horizonally.

4. A two-cycle inboard engine for driving a propeller shaft of a small watercraft comprising:

a water discharge passageway located in a crankcase of the engine for communicating a crank chamber with the atmosphere; and a closing member located at one end of a drain pipe connected to a side wall of the crankcase and in fluid communication with said water discharge passageway, said closing member having a manually operated portion for opening and closing the closing member.

5. An engine for a small watercraft as claimed in claim 4 wherein said water discharge passageway is oriented substantially horizontally.

6. A two-cycle inboard engine for driving a propeller shaft of a small watercraft comprising:

a housing for said engine;

a water discharge passageway located in a crankcase of the engine providing fluid communication between a crank chamber and a space defined by said crankcase and said housing; and a closing member fitted in said water discharge passageway, said closing member having a manually operated portion for opening and closing the closing member.

7. An engine for small watercraft as claimed in claim 6 wherein said closing member is located at a lower end portion of a side wall of the crankcase.

8. An engine for a small watercraft as claimed in claim 6 wherein said water discharge passageway is oriented substantially horizontally.

* * * * *